US012059718B2

(12) United States Patent
Ebner et al.

(10) Patent No.: US 12,059,718 B2
(45) Date of Patent: Aug. 13, 2024

(54) CAN PACKAGING, CAN PACKAGING BLANK AND APPARATUS AND METHOD FOR PRODUCTION THEREOF

(71) Applicant: Linhardt GmbH & Co. KG, Viechtach (DE)

(72) Inventors: Stephan Ebner, Viechtach (DE); Gustav-Konstantin Gross, Viechtach (DE)

(73) Assignee: Linhardt GmbH & Co. KG, Viechtach (DE)

( * ) Notice: Subject to any disclaimer, the term of this patent is extended or adjusted under 35 U.S.C. 154(b) by 705 days.

(21) Appl. No.: 17/250,646

(22) PCT Filed: Aug. 7, 2019

(86) PCT No.: PCT/EP2019/071219
§ 371 (c)(1),
(2) Date: Feb. 16, 2021

(87) PCT Pub. No.: WO2020/035367
PCT Pub. Date: Feb. 20, 2020

(65) Prior Publication Data

US 2021/0170464 A1 Jun. 10, 2021

(30) Foreign Application Priority Data

Aug. 17, 2018 (DE) ..... 10 2018 120 091.9

(51) Int. Cl.
*B21C 23/20* (2006.01)
*B65D 1/16* (2006.01)
*B65D 1/46* (2006.01)

(52) U.S. Cl.
CPC ..... *B21C 23/205* (2013.01); *B65D 1/165* (2013.01); *B65D 1/46* (2013.01)

(58) Field of Classification Search
CPC ..... B21C 23/02; B21C 23/20; B21C 23/205; B65D 1/165; B65D 1/46
See application file for complete search history.

(56) References Cited

U.S. PATENT DOCUMENTS 2,904,173 A 9/1959 Braun et al.

FOREIGN PATENT DOCUMENTS

| | | | |
|---|---|---|---|
| CN | 105327962 | A | 2/2016 |
| DE | 4133340 | A1 | 4/1993 |
| JP | S5884611 | A | 5/1983 |

*Primary Examiner* — Teresa M Ekiert
(74) *Attorney, Agent, or Firm* — WELSH FLAXMAN & GITLER LLC

(57) ABSTRACT

The invention relates to an apparatus for producing a can packaging blank by backward extrusion. The apparatus has a die wall and an extrusion punch, wherein the die has a die base and a die wall having a die wall height HG. The die wall has, in the region thereof adjacent to the die base, at least one protrusion having predetermined width (B), predetermined height (H), predetermined depth (T) and predetermined cross-section, wherein the height (H) of the protrusion equals 95% of the die wall height (HG) at maximum.

13 Claims, 5 Drawing Sheets

CAN PACKAGING, CAN PACKAGING BLANK AND APPARATUS AND METHOD FOR PRODUCTION THEREOF

CROSS REFERENCE TO RELATED APPLICATION

This application claims the benefit of PCT International Patent Application No. PCT/EP2019/071219, entitled "Can packaging, can packaging blank and apparatus and method for production thereof", filed Aug. 7, 2019, which claims the benefit of German Patent Application No. DE102018120091.9 filed Aug. 17, 2018, the content of which is incorporated herein by reference.

BACKGROUND OF THE INVENTION

Technical Field

The invention relates to a can packaging, a can packaging blank and a device and a method for its production.

Can packagings are often formed from blanks, which have been produced by means of an extrusion process. An extrusion process is a deformation process, wherein the deformation of a workpiece takes place by means of compressive loading. The flow direction of the material relative to the punch movement direction forms the basis for distinguishing between forward extrusion (material flow and stamp movement direction are the same), reverse extrusion (material flow and punch movement direction are opposite) and transverse extrusion (material flow crosswise to the punch movement direction).

The production of a thin-walled metal tube by reverse extrusion is described in German Patent No. DE 29 32 016 C2. DE 197 08 826 A1 describes a can made from a thin-walled sheet metal, comprising a bottom part produced in one piece by extrusion, a tubular upright middle part adjoining the latter and a lid located on the side of the middle part lying opposite the bottom part and connected to the middle part by flanging. The bottom part comprises ribs, beading or suchlike, which are introduced into the bottom part in the course of the extrusion process during the manufacture of the bottom part with the middle part.

In connection with can packaging, it is often desired to design the latter not only optically but also haptically distinctive and distinguishable from one another. This is usually achieved by a deformation or shaping treatment of the can packaging blank or the can packaging. The problem occurs here, however, that each deformation of the outer surface is accompanied by a corresponding deformation of the inner surface and thus of the can container interior.

A circumferential waistline formation of the can, for example, has the consequence that the can interior first tapers and then towards the bottom of the can widens again. Consequently, there is on the one hand a reduced interior space available compared to a cylindrical can without a waistline. On the other hand, problems arise during the filling of the can packaging, which can only take place at lower pressures and therefore with longer time consumption. Problems also arise with the emptying of the can packaging, since each shaping diverging from a smooth, continuous inner surface helps to cause filling substance residues to remain and makes this more probable.

There thus continues to be a need for can packagings which have a haptically distinguishable outer surface and which at the same time can be filled easily and quickly and emptied as free as possible from residues.

SUMMARY OF THE INVENTION

The problem underlying the present invention is to make available a can packaging, which has a haptically distinguishable outer surface and which at the same time can be filled easily and quickly and emptied as free as possible from residues. Further advantageous aspects, details and developments of the invention emerge from the dependent claims, the description and the drawings.

The present invention makes available a device for the production of a can packaging blank by reverse extrusion. The device comprises a die and a punch, wherein the die comprises a die bottom and a die wall with a die wall height. The die wall comprises in its region adjacent to the die bottom at least one projection with a predetermined width, predetermined height, predetermined depth and predetermined cross-section, wherein the height of the projection amounts to a maximum of 95% of the die wall height.

By use of the projection provided according to the invention in the region of the die wall adjacent to the die bottom, a haptically perceptible shaping of the outer side of the wall of a can packaging blank or rather the can packaging produced from this blank can be carried out, without their being a change in the inner surface of the wall of the can packaging blank or the can packaging. The structuring of the outer surface, i.e. the outer side of the wall of the can packaging blank, does not in fact take place in the manner known from the prior art by a subsequent deformation, but rather during the production process when the can packaging comes into being. In all subsequent deformation steps, the wall of the can packaging is dented, notched, bulged outwards or otherwise changed whilst at the same time retaining the previously formed wall thickness. All the deformation steps have in common the fact that the deformation visible at the outer side can be seen as detrimental at the inner side. That is to say that, if the can wall is dented, the corresponding area appears at the outer surface as a depression and at the inner surface as an elevation. The same applies the other way round: if the can wall is dented outwards, an elevation appears at the outer side, which finds its equivalent in a depression at the inner side of the wall of the can packaging.

In contrast with this, the structuring of the outer side of the wall brought about by the device according to the invention for the production of a can packaging blank takes place directly during the production process by reverse extrusion by means of a variation of the wall thickness of the can packaging blank. The effect of the projection provided in the region of the die wall adjacent to the die bottom is that, in the region of the projection, the metal flowing backwards gives rise to a recess, formed corresponding to the shape of the projection, in the wall of the can packaging blank being formed. A point-shaped spike with a height of 0.1 mm as a projection at the die wall may be mentioned as the simplest example. This spike leaves a groove with a depth of 0.1 mm in the metal flowing by and forming the wall. This depression visible at the outer side does not however have any equivalent point in the form of an elevation at the inner side of the can wall. The latter remains smooth and continuous just as in the case of a can packaging without structuring of the outer side.

On the basis of this basic idea of a projection in the form of a spike, an almost arbitrary number of possible variations emerge. In the first place, the number of projections and their distribution can be varied around the circumference of the die wall. The formation of the outer side of the wall, for example, can thus take place in the form of two grooves arranged close beside one another, but can also be constituted as a multiplicity of grooves distributed in a relief-like manner arbitrarily around the circumference of the can packaging.

The shape of the projection can also be varied, as can its width, height, depth and cross-section. Depressions in the wall of the can packaging visible at the outer side and constituted relief-like can thus be produced virtually in an arbitrary variety of ways. For example, from a projection with a semicircular cross-section with a circle radius of 1 mm, a semicircular recess with a maximum depth of 0.5 mm thus arises in the wall of the can packaging. A projection with a triangular cross-section, the base whereof arranged at the die wall has a width of 2 mm and the height whereof, measured from the base to the triangle apex, amounts for example to 1 mm, leaves behind a corresponding recess in the wall of the can packaging.

These few mentioned examples, which are explained below in greater detail in connection with the preferred embodiments of the invention, already show the extreme diversity of the design options which are created by the device according to the invention.

A further possible variation results from coordinating the height of the projection and the thickness of the circular blank used for the production of the can packaging. A depression in the wall of the can packaging is formed only over a partial region of the can packaging, which is formed from the section of the circular blank that comes into contact with the respective projection. If, for example, the projection, measured from the die bottom along the die wall, thus has a height of 1 mm and if a circular blank with a thickness of 2 mm is used for the formation of the can packaging blank, the groove formed by the projection extends, starting from the bottom of the can packaging blank, over 50% of the vertical extension of the can packaging blank. If the circular blank has a thickness of 4 mm, the groove correspondingly extends only over 25% of the vertical extension of the can packaging blank. The reason for this lies in the fact that the material of 3 mm of the circular blank thickness does not come into contact at all with the projection, i.e. cannot form a corresponding depression either.

Thus, if one were to use a 1 mm thick circular blank with a 1 mm high projection, the depression would extend over the entire extension of the can packaging blank in the longitudinal direction. This is not however desired, since depressions in the region of the open end of the can packaging blank facing away from the bottom of the can packaging blank are associated with clear drawbacks. As is known to the person skilled in the art, a can packaging blank, in the course of its further processing to form a can packaging, is provided at its open end with a tapering shoulder and a rolled edge. The rolled edge is used for the subsequent fastening of a sealing cap, a metering device or another arbitrarily formed applicator. A tight connection of the cap and the can packaging is however absolutely essential, since it is necessary to prevent the filling substance from inadvertently exiting. Such a tight connection can only be ensured in the case of a smooth outer side of the wall of the can packaging blank in the region provided for the formation of a shoulder and a rolled edge.

The predetermined height of a projection corresponds in all embodiments of the present invention to the maximum extension of the projection in a direction parallel to the die wall. The height of a projection can of course vary over the width and also over the depth of the projection. By stating that the height of a specific projection corresponds to the maximum extension of the projection in a direction parallel to the die wall, this height is however unequivocally defined.

According to the invention, the height of the projection provided in the region of the die wall adjacent to the die bottom or the height of the provided projections amounts to a maximum of 95% of the die wall height. As a result of this limitation, it is ensured that the region of the can packaging blank that is provided for the formation of the shoulder and the rolled edge of the can packaging does not have any depression or relief-like structure at the outer side of its wall. As a result of the smooth, continuously running outer side present in this region, a tight connection of the cap and the can packaging can be ensured.

It should be mentioned that a groove according to the strict definition is a surface deficiency, which represents a linear recess with a rounded or flat base. In contrast, a crack has a sharp base and grooves are produced by the ideal geometrical shape of the tool blade. As already stated, by means of the differing shape of the projection provided at the die wall or the projections provided there, an extremely great diversity of depressions of the outer side of the can packaging blank can be produced, which are referred to as "relief-like formation" of this outer side. All the structures of the wall of the can packaging blank visible as a depression at the outer side are referred to in the context of the present text as "grooves", and indeed irrespective of their specific formation and irrespective of the definitions cited above.

The die wall preferably comprises a plurality of projections in its region adjacent to the die bottom. As already mentioned, this embodiment greatly increases the possible variations in the formation of the structure of the outer side of the can packaging blank and a can packaging produced therefrom. It should be made clear that a number or plurality of projections can be provided around the circumference of the die wall.

If a plurality of projections are provided, an arbitrary number of projections can have the same width, height, depth and cross-section, whilst another group of projections can also have the same width, height, depth and cross-section, which however differ from those of the first group. It is also possible for all the projections to have a different width and/or different height and/or different depth and/or different cross-section. In principle, an arbitrary combination of projections can be selected, which each has its own specific width, height, depth and cross-section. However, the height of each of the projections provided in the region of the die wall adjacent to the die bottom may amount to a maximum of 95% of the die wall height.

The width of a specific projection corresponds in all the embodiments of the present invention to the maximum extension of the projection in a direction parallel to the die bottom. Since the die wall generally has a curvature in a plane parallel to the die bottom and it may be of advantage to provide the projection with the same curvature, the width of the projection in these cases corresponds to the length of a line curved corresponding to the curvature of the die wall. It is clear to the person skilled in the art that in principle an infinite number of directions exist parallel to the die bottom, and also that a specific projection can be described by a plurality of the aforementioned curved lines, by stating that the width of a specific projection corresponds to the maximum extension of the projection, this width is however unequivocally defined. Even with an arbitrarily formed projection varying in the width over its height, its maximum width is specified.

The height of a specific projection corresponds in all the embodiments of the present invention to the maximum extension of the projection in a direction parallel to the die wall. The height of a projection can of course vary over the width and also over the depth of the projection. By stating that the height of a specific projection corresponds to the maximum extension of the projection in a direction parallel to the die wall, this height is however unequivocally defined.

The depth of a specific projection corresponds in all the embodiments of the present invention to the maximum extension of the projection in a direction normal to the die wall. The depth of a projection can of course vary over the width and also over the height of the projection. By stating that the depth of a specific projection corresponds to the maximum extension of the projection in a direction normal to the die wall, this depth is however unequivocally defined.

In principle, the projections or a single projection can have an arbitrary width, which is limited only by the circumference of the can packaging blank produced with the aid of the die. The width of a projection can, for example, thus amounts to a quarter, a third or also half the circumference of the can packaging blank. The projections preferably have a width of 0.1 mm to 10 mm, particularly preferably 0.5 mm to 5 mm and very particularly preferably from 1 mm to 2.5 mm. If a plurality of projections are provided, an arbitrary number of projections can have an identical first width, which for example lies in the range between 1.5 mm and 2 mm, whereas another group of projections can have an identical second width, which however differs from the first width and lies for example in the range between 2 mm and 2.5 mm. In this embodiment, the two groups of projections and therefore also the two groups of grooves in the wall of the can packaging can be formed lying opposite one another as sections with grooves of the same width in each case. Grooves of different width can however also follow one another in an alternating manner. It is also possible for all the projections to have a different width. In principle, an arbitrary combination of projections can be selected, which each have their own specific width. It is evident to the person skilled in the art that, merely by virtue of the variation of the width of the projections, an almost infinite variety arises for the relief-like formation of the outer side of the can packaging blank and of the can packaging produced therefrom. The number of groups of grooves of the same width is limited only by the circumference of the can packaging.

The projections preferably have a height of 0.1 mm to 30 mm, particularly preferably 0.5 mm to 10 mm and very particularly preferably of 1 mm to 5 mm. If a plurality of projections is provided, an arbitrary number of projections can have an identical first height, which for example lies in the range between 2 mm and 3.5 mm, whereas another group of projections can have an identical second height, which however differs from the first height and lies for example in the range between 3.5 mm and 4.5 mm. Since a specific can packaging blank is produced from a specific circular blank, which has a specific thickness, grooves of differing length in the longitudinal direction of the can packaging blank arise in the wall of the can packaging blank due to projections of differing height. In this embodiment, the aforementioned two groups of projections and therefore the two groups of grooves in the wall of the can packaging can be formed opposite one another as sections with grooves of the same length in each case. Grooves of different length can however also follow one another in an alternating manner. It is also possible for all the projections to have a different height. In principle, an arbitrary combination of projections can be selected, which each have their own specific height. It is evident to the person skilled in the art that, merely by virtue of the variation of the height of the projections, an almost infinite variety arises for a relief-like formation of the can packaging blank and of the can packaging produced therefrom. The number of groups of grooves of the same height is limited only by the circumference of the can packaging. The height of the projections can also be constantly varied according to a specific pattern, so that grooves of different length are produced for example around the entire circumference of the can packaging blank or the can packaging, which in their sequence replicate for example a wave pattern.

The projections preferably have a depth of 0.01 mm to 1 mm, particularly preferably 0.05 mm to 0.5 mm and very particularly preferably of 0.1 mm to 0.25 mm. If a plurality of projections is provided, an arbitrary number of projections can have an identical first depth, which for example lies in the range between 0.15 mm and 0.2 mm, whereas another group of projections can have an identical second depth, which however differs from the first depth and lies for example in the range between 0.2 mm and 0.25 mm. In this embodiment, the two groups of projections and therefore also the two groups of grooves in the wall of the can packaging can be formed lying opposite one another as sections with grooves of the same depth in each case. Grooves of different depth can however also follow one another in an alternating manner. It is also possible for all the projections to have a different depth. In principle, an arbitrary combination of projections can be selected, which each have their own specific depth. It is evident to the person skilled in the art that, merely by virtue of the variation of the depth of the projections, an almost infinite variety arises for a relief-like formation of the can packaging blank and of the can packaging produced therefrom. The number of groups of grooves each of the same depth is limited only by the circumference of the can packaging.

The projections provided in the region of the die wall adjacent to the die bottom have a cross-section parallel to the die bottom, wherein the cross-section is preferably formed triangular, rectangular, in particular trapezoidal, circle segment-shaped, in particular semicircular. In principle, the cross-section of the projections can be selected in a virtually arbitrary manner within technically determined limits which are evident to the person skilled in the art. The aforementioned cross-sections produce grooves having haptically and optically particularly ambitious characteristics and are therefore preferred within the scope of the present invention.

The projections are preferably arranged circumferentially around the entire circumference of the die wall. In this embodiment, a haptically and optically similar or even identical impression results over the entire circumference of the can packaging blank produced with the aid of the die and of the die packaging produced therefrom. It may however also be preferable for other purposes to concentrate the projections in a specific partial region of the die wall and therefore to concentrate the grooves in a specific partial region of the can packaging blank or the can packaging.

The punch preferably comprises a circumferential bead in its edge region adjacent to the die bottom in the state of use. The thickness of the wall of the can packaging blank is defined by the gap remaining between the bead and the die wall. In the region of a projection of the die wall, the gap remaining between the bead and the projection defines the thickness of the wall of the can packaging blank in the region of a groove.

The can packaging blank and also the can packaging produced therefrom can in principle have a horizontal cross-section selected in a virtually arbitrary manner within technically determined limits which are evident to the person skilled in the art. This cross-section corresponds to the cross-section of the die wall parallel to the die bottom. Can packaging blanks very often have the shape of a hollow, vertical circular cylinder. According to a preferred embodiment of the present invention, therefore, the die bottom with the die wall forms a hollow, vertical circular cylinder. The diameter of the circular cylinder parallel to the die bottom preferably amounts to between 10 mm and 120 mm. An oval cross-section of the can packaging blank parallel to the die bottom is also easy to implement and optically attractive. The same applies to a rectangular, square, triangular or generally polygonal cross-section. It should however be emphasized once again that any conceivable cross-sectional shape is in principle possible.

The present invention also includes a method for the production of a die packaging blank by reverse extrusion, comprising the steps a) provision of a device for the production of a die packaging blank by reverse extrusion with a die and a punch such as have been described above,
b) insertion of a circular blank into the die,
c) introduction of the punch and exertion of a pressing force on the circular blank,
d) removal of the can packaging blank from the die.

All of the advantages and particular features mentioned in connection with the various embodiments of the device according to the invention for the production of a can packaging blank by reverse extrusion also relate equally to the method according to the invention for the production of a can packaging blank by reverse extrusion. To avoid repetition, reference is made to the corresponding comments above.

The diameter of the circular blank is preferably selected such that the circular blank, after being placed in the die before the introduction of the punch, lies in its edge region on the projections. The punch is then introduced into the die and exerts pressure on the circular blank. The circular blank material is then first pressed downwards up to the die bottom and is in contact with these projections over height H of the projections.

According to a particularly preferred embodiment, the projections provided in the region of the die wall adjacent to the die bottom have a predetermined height, wherein the predetermined height amounts to a maximum of 95% of the thickness of the circular blank. Embodiments are particularly preferable in which projections provided in the region of the die wall adjacent to the die bottom have a predetermined height, wherein the predetermined height amounts to a maximum of 75%, particularly preferably a maximum of 50% of the thickness of the circular blank. In addition, embodiments are preferred in which the projections provided in the region of the die wall adjacent to the die bottom have a predetermined height, wherein the predetermined height amounts to at least 5%, preferably at least 15%, particularly preferably at least 25% of the thickness of the circular blank.

It should be made clear that the preferred embodiments described here relate to advantageous variants of a method for the production of a can packaging blank by reverse extrusion, which has been carried out using a device for the production of a can packaging blank by reverse extrusion with a die and a punch such as they have been described above. The limitation provided according to the invention, according to which the height of the projections provided in the region of the die wall adjacent to the die bottom or the height of the provided projections amounts to a maximum of 95% of the die wall height, is therefore in any case also complied with when the method for the production of a can packaging blank is carried out by reverse extrusion. As already stated, it is ensured by this limitation that the region of the can packaging blank that is provided for the formation of the shoulder and the rolled edge of the can packaging does not have any depression or relief-like structure at the outer side of its wall. A tight connection of the cap and the can packaging can thus be ensured by the smooth, continuously running outer side thus achieved. In practice, however, it is often simpler to set the height of the projections in relation to the thickness of the circular blank used. It can thus be quickly and easily determined in which range the thickness of a circular blank may lie that is to be used in a specific die equipped with a plurality of specifically constituted projections of predetermined height.

As already stated, a possible variation for the distinctive form of the grooves in the can packaging blank results from coordinating the height of the projection or projections and the thickness of the circular blank used for the production of the can packaging. The relief-like structure in the wall of the can packaging blank is formed only over the partial region of the can packaging blank which is formed from the section of the circular blank that comes into contact with the projections. Thus, if for example the projection, measured from the die bottom along with the die wall, has a height of 2 mm and a circular blank with a thickness of 3 mm is used for the formation of the can packaging blank, the groove formed by the projection, starting at the bottom of the can packaging, extends over 66% of the vertical extension of the can packaging. If the circular blank has a thickness of 4 mm, the groove correspondingly extends only over 50% of the vertical extension of the can packaging. The reason for this lies in the fact that the material of 2 mm of the circular blank thickness does not come into contact at all with the projections, cannot form a corresponding depression either.

If a circular blank with a thickness corresponding to the height of the projections or even a smaller thickness were to be used, the grooves formed in the wall of the can packaging would always extend over the entire extension of the can packaging in the longitudinal direction. As already stated, such embodiments are however associated with drawbacks and are undesired.

According to a further preferred embodiment, the circular blank used in the method according to the invention or which is used together with the device according to the invention is made of metal, in particular aluminium, an aluminium alloy or copper. Reverse extrusion processes can be carried out particularly well and advantageously with suitable metals known to the person skilled in the art. Aluminium and copper are particularly well suited and aluminium, in particular, is preferred. Any kind of suitable metal alloy known to the person skilled in the art, in particular aluminium alloy, can of course be used. The selection of the material of the circular blank is usually made by the person skilled in the art depending on the properties desired for the finished can packaging.

The present invention also comprises a can packaging blank with a main axis defining a longitudinal direction and a wall comprising an outer side and an inner side. The wall of the can packaging blank has a variable wall thickness at least over a partial region of the can packaging blank extending in the longitudinal direction. The partial region of the can packaging blank with a variable wall thickness extends, starting from the bottom of the can packaging blank, over a maximum of 95% of the height in the longitudinal direction of the can packaging blank. The variable wall thickness is brought about by the fact that only the outer side of the wall is constituted in a relief-like manner.

According to the invention, therefore, the partial region of the can packaging blank with a variable wall thickness, starting from the bottom of the can packaging blank, thus extends over a maximum of 95% of the height in the longitudinal direction of the can packaging blank. As already stated in connection with the device and the method according to the present invention, it is ensured by this limitation that the region of the can packaging blank which is provided for the subsequent formation of the shoulder and the rolled edge of the can packaging does not have any depression or relief-like structure at the outer side of the wall. A tight connection of the cap and the can packaging can be ensured by the smooth, continuously running outer side present in this region.

As has also already been stated, the very fundamental advantage of the method according to the invention and the device according to the invention lies in the fact that, in contrast with the can packagings known from the prior art with a structured outer surface, the structuring of the outer surface brought about by the device according to the invention for the production of a can packaging blank takes place directly during the production process by reverse extrusion by varying the wall thickness of the can packaging blank. The effect of the projection provided in the region of the die wall adjacent to the die bottom is that, in the region of the projection, the metal flowing backwards causes a recess, formed corresponding to the shape of the projection, in the wall of the can packaging blank being formed. Such a depression visible at the outer side of the can packaging blank does not however find any equivalent in the shape of an elevation at the inner side of the wall of the can packaging blank. The latter remains smooth and continuous as in the case of a can packaging without structuring of the outer side. Can packaging blanks and subsequently can packagings are thus formed which have a discontinuous or variable wall thickness in their cross-sectional area at least over a partial region extending in the longitudinal direction, wherein the variable wall thickness is brought about by the fact that only the outer side of the wall is constituted in a relief-like manner. Such can packagings or can packaging blanks, irrespective of the method used for their production, are not known from the prior art.

It should once again be stressed that the variable wall thickness is brought about by the fact that only the outer side of the wall is constituted in a relief-like manner. The inner side of the wall of the can packaging blank, on the other hand, remains unchanged, i.e. is constituted smooth and continuous as in the case of a can packaging without structuring of the outer side. This applies irrespective of the cross-sectional area of the can packaging blank. As already stated, the die bottom can be formed circular, oval, rectangular, square, triangular or polygonal, wherein the die wall is arranged vertically on the die bottom. This means that the cross-section of the die parallel to the die bottom can also have a circular, oval, rectangular, square, triangular or polygonal shape. It is clear to the person skilled in the art that, with the aid of such devices, can packaging blanks can be produced in a similar variety of shapes. A cross-sectional area of the can packaging blank arranged normal to main axis HA of the can packaging blank can thus correspondingly not only have a circular, but also an oval, rectangular, square, triangular or polygonal shape. All the embodiments have in common the fact that the variable wall thickness is brought about solely by a relief-like formation of the outer side of the wall. By stating that the inner side of the wall of the can packaging blank is constituted smooth and continuous, it thus means, for example in the case of a circular cross-section, that the inner side of the wall has a constant curvature. In the case of a square cross-section, the expression "continuous" does not relate to the entire inner side, since there can be no mention of a "continuous" transition at the corners of the square. In this case, "smooth and continuous" or "constant" relates to each individual one of the four inner surfaces of the square.

Generally speaking, the feature that "only the outer side of the wall is constituted in a relief-like manner", at the same time includes the assertion that such a relief-like formation is not present at the inner side of the wall. At the inner side, therefore, there are no depressions, elevations or otherwise constituted structures.

The partial region of the can packaging blank with a variable wall thickness, starting from the bottom of the can packaging blank, preferably extends over a maximum of 90%, preferably a maximum of 85%, particularly preferably a maximum of 80%, in particular preferably a maximum of 75% and very particularly preferably over a maximum of 50% of the height in the longitudinal direction of the can packaging blank.

Embodiments are also preferred in which the partial region of the can packaging blank with a variable wall thickness extends, starting from the bottom of the can packaging blank, over at least 5%, preferably at least 15%, particularly preferably at least 25% of the height in the longitudinal direction of the can packaging blank.

Within the scope of the present invention, can packaging blanks are particularly preferred, the relief-like formation of the outer side of the wall of which is brought about by groove-like depressions in the outer side. It should once again be mentioned that in all cases the inner side of the wall is constituted continuous.

The groove-like depression extending from the outer surface into the wall of the can packaging blank particularly preferably run parallel to the main axis (HA) of the can packaging blank.

The present invention also comprises a can packaging blank which can be produced using one of the devices described above for the production of a can packaging blank by reverse extrusion.

The present invention also comprises a can packaging blank which can be produced by one of the methods described above for the production of a can packaging blank by reverse extrusion.

Finally, the present invention also comprises a can packaging which can be produced using one of the can packaging blanks described above. Proceeding from a can packaging blank produced according to an embodiment of the present invention, only steps known to the person skilled in the art, such as for example the formation of the shoulder and the flanging of the opening of the can packaging blank facing away from the can packaging bottom for the formation of a rolled edge, need to be carried out for the production of the finished can packaging.

Developments, advantages and possible applications of the invention also emerge from the following description of examples of embodiment and from the figures.

BRIEF DESCRIPTION OF THE DRAWINGS

The invention will be explained in greater detail below with the aid of examples of embodiment in connection with the drawings. In the figures.

DETAILED DESCRIPTION OF THE INVENTION

Figure 1:
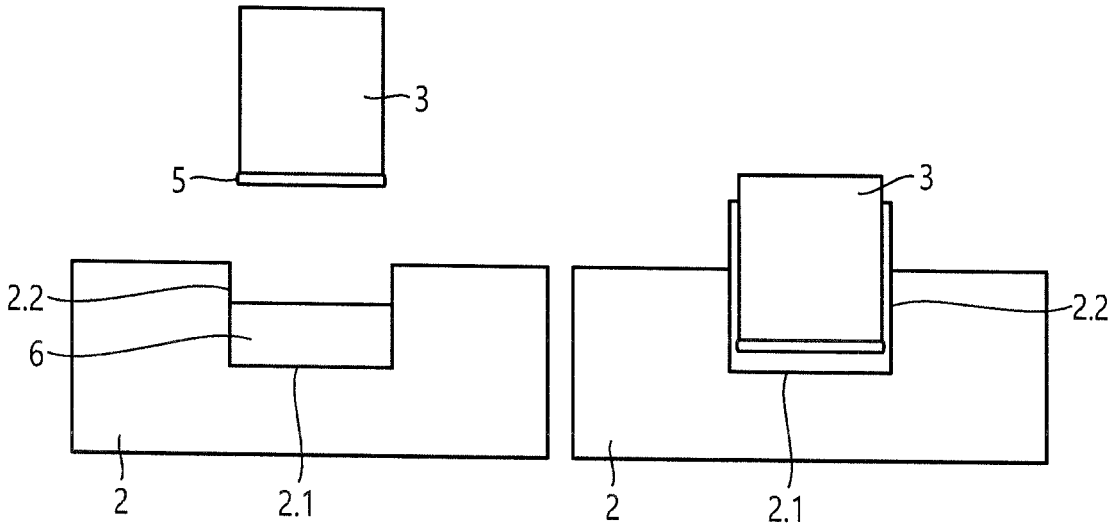
FIG. 1 shows in a diagrammatic representation a vertical cross-section through a die known from the art.

FIG. 1 shows in a diagrammatic representation a vertical cross-section through a die 2 known from the prior art. Punch 3, die 2 with die bottom 2.1 and die wall 2.2 are shown. Punch 3 comprises a circumferential bead 5

In the left-hand part of FIG. 1, punch 3 is represented spaced apart from die 2, i.e. the situation before the formation of the can packaging blank. Circular blank 6 is inserted into die 2.

In the right-hand part of FIG. 1, punch 3 is introduced into die 2 and exerts pressure on the circular blank 6. As a result of this compressive loading, a deformation of circular blank 6 occurs, which flows upwards opposite to the direction in which the punch is moving. The wall thickness of the can packaging blank formed by reverse extrusion is defined by the gap remaining between circumferential bead 5 of punch 3 and die wall 2.2.

Figure 2:
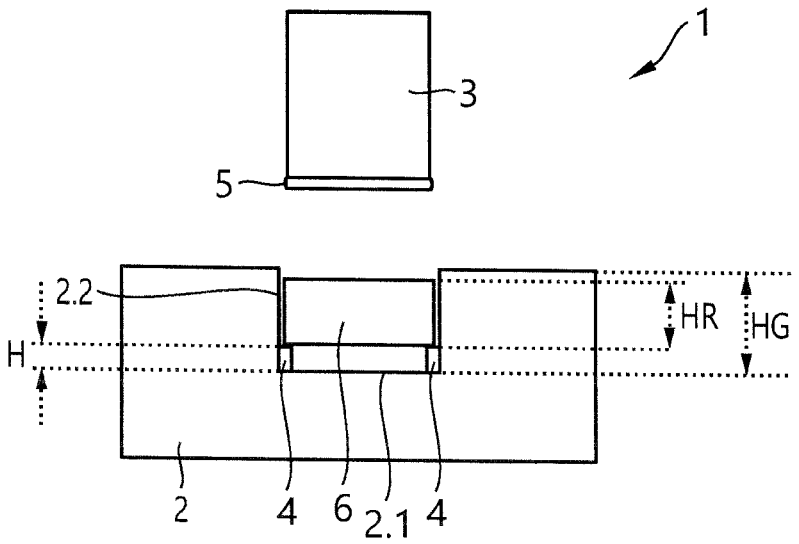
FIG. 2 shows in a diagrammatic representation a vertical cross-section through a device according to the invention for the production of a can packaging blank by reverse extrusion.

FIG. 2 shows in a diagrammatic representation a vertical cross-section through a device according to the invention for the production of a can packaging blank by reverse extrusion. The representation is similar to the device known from the prior art shown in the left-hand part of the FIG. 1. Punch 3, die 2 with die bottom 2.1 and die wall 2.2 are shown. Punch 3 comprises a circumferential bead 5. Die wall 2.2 comprises in its region adjacent to die bottom 2.1 a plurality of projections 4 with a width of 1 mm, a height H of 1.5 mm, a depth of 0.15 mm and a cross-section formed trapezoidal parallel to die bottom 2.2.

Circular blank 6 is inserted into die 2. Circular blank 6 is made of aluminium and has a thickness HR of 4.5 mm. The height of die wall HG amounts to 6 mm. The height of projections 4 thus amounts to 25% of the height of the die wall. Circular blank 6 lies on projections 4 before the introduction of punch 3. Punch 3 is then introduced into die 2 and exerts pressure on circular blank 6. The circular blank material is then first pressed downwards up to die bottom 2.2 and is then in contact with projections 4 over height H of 1.5 mm. Since thickness HR of the circular blank is a factor of 3 greater than height H of projections 4, the groove-like depressions in the wall of the can packaging blank thus formed by reverse extrusion extend over a third of the extension of the can packaging blank in longitudinal direction LR (see FIG. 4A).

Figure 3A:
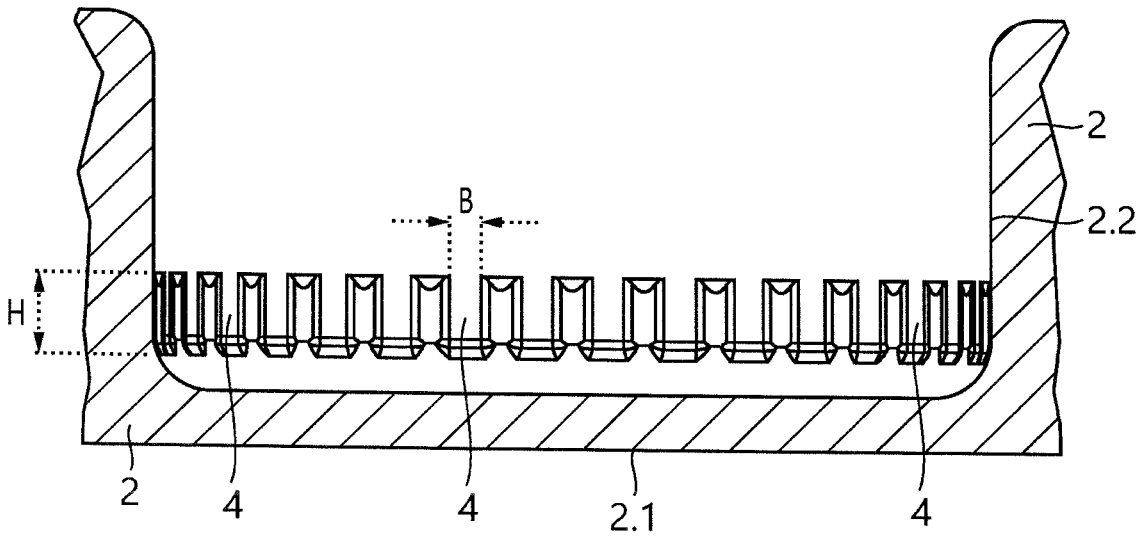
FIG. 3A shows in a diagrammatic representation a die according to the invention in a side plan view.

FIG. 3A shows in a diagrammatic representation a die 2 according to the present invention in detail in a side plan view. Die 2 with die bottom 2.1 and die wall 2.2 is shown. Die wall 2.2 comprises in its region adjacent to die bottom 2.1 a plurality of projections 4. Projections 4 have a width B of 5 mm, a height H of 10 mm, a depth of 0.15 mm and a cross-section formed trapezoidal parallel to die bottom 2.2. The edges of projections 4 adjacent to die bottom 2.1 are, beveled i.e. do not project perpendicular from die wall 2.1, but rather run at an angle of around 45 relative to die wall 2.1.

Figure 3B:
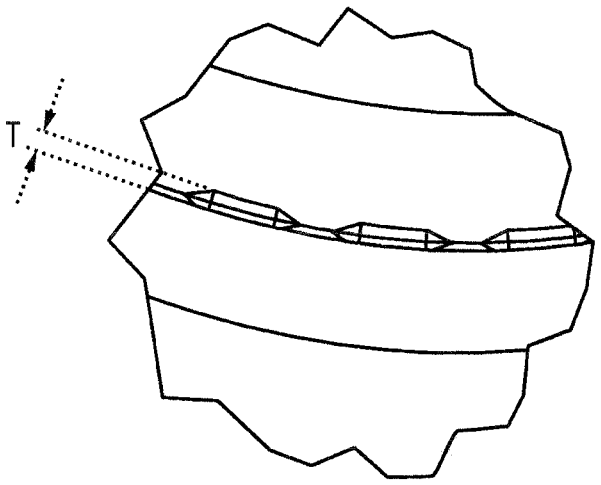
FIG. 3B shows in a diagrammatic representation a detail of the die according to FIG. 3A in a plan view.

Depth T of projections 4 of 0.15 mm can be seen from the detail of the die according to FIG. 3A shown in plan view in FIG. 3B in a diagrammatic representation.

All projections 4 of the embodiment of the die according to the invention shown in FIGS. 3A and 3B have the same height, width, depth and the same cross-section and are arranged distributed equidistant from one another spaced apart uniformly around the entire circumference of the die wall.

Figure 4A:
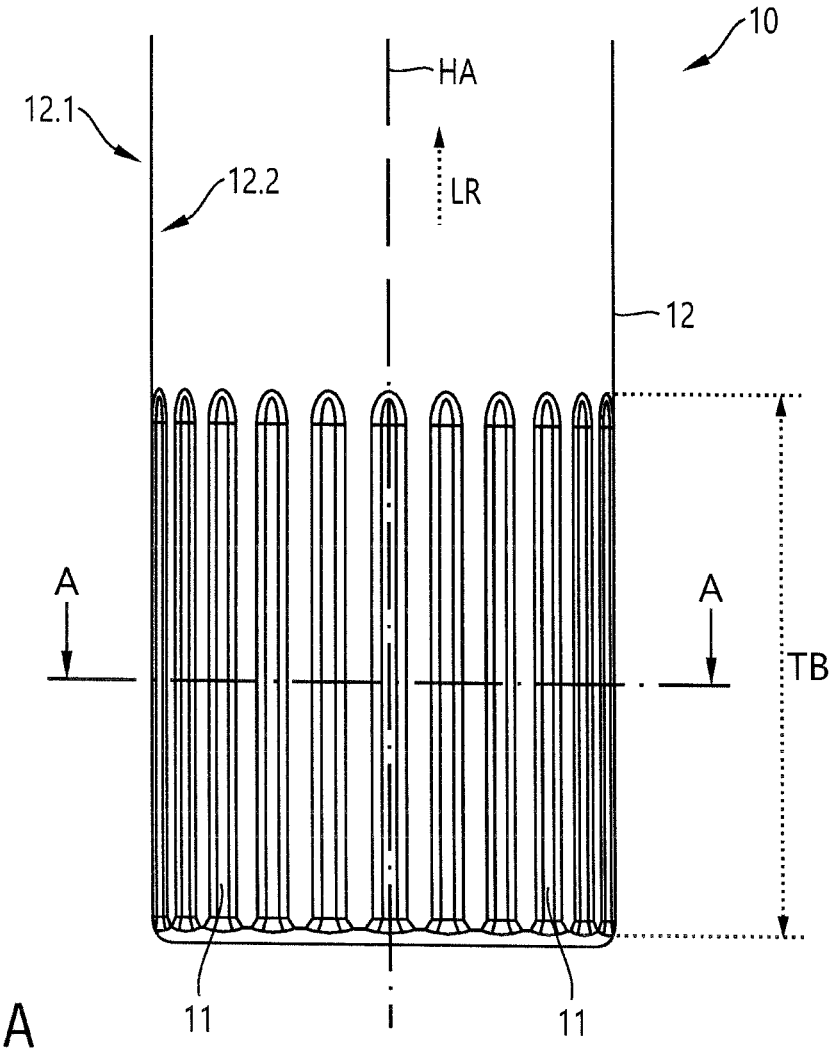
FIG. 4A shows in a diagrammatic representation a can packaging blank according to the invention in a side plan view.
Figure 4B:
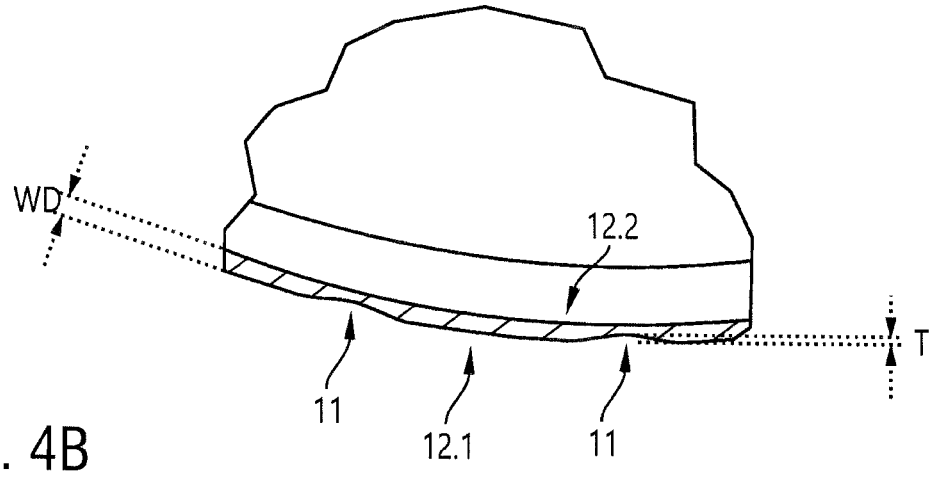
FIG. 4B shows in a diagrammatic representation a magnified detail of a cross-section along plane A-A of FIG. 4A.

FIG. 4A shows in a diagrammatic representation a can packaging blank 10 according to the invention in a side plan view. A magnified detail of the cross-section along plane A-A of FIG. 4A is shown in a diagrammatic representation in FIG. 4B. Can packaging blank 10 has a main axis HA defining a longitudinal direction LR and a cross-sectional area arranged normal to main axis HA, wherein wall 12 of can packaging blank 10 comprises an outer side 12.1 and an inner side 12.2. Over a partial region TB of can packaging blank 10 extending in longitudinal direction LR, wall 12 has a variable wall thickness WD in the cross-sectional area of can packaging blank 10, which is brought about by groove-like depressions 11 in outer surface 12.1, wherein inner surface 12.2 runs continuously over the region of groove-like depressions 11. Depth T of groove-like depressions 11 corresponds to depth T of projections 4 of 0.15 mm (see FIG. 3B).

Grooves 11 of can packaging blank 10 formed by projections 4 of die 2 have the same height, width, depth and the same cross-section and are arranged distributed equidistant uniformly spaced apart from one another around the entire circumference of can packaging blank 10.

Figure 5:
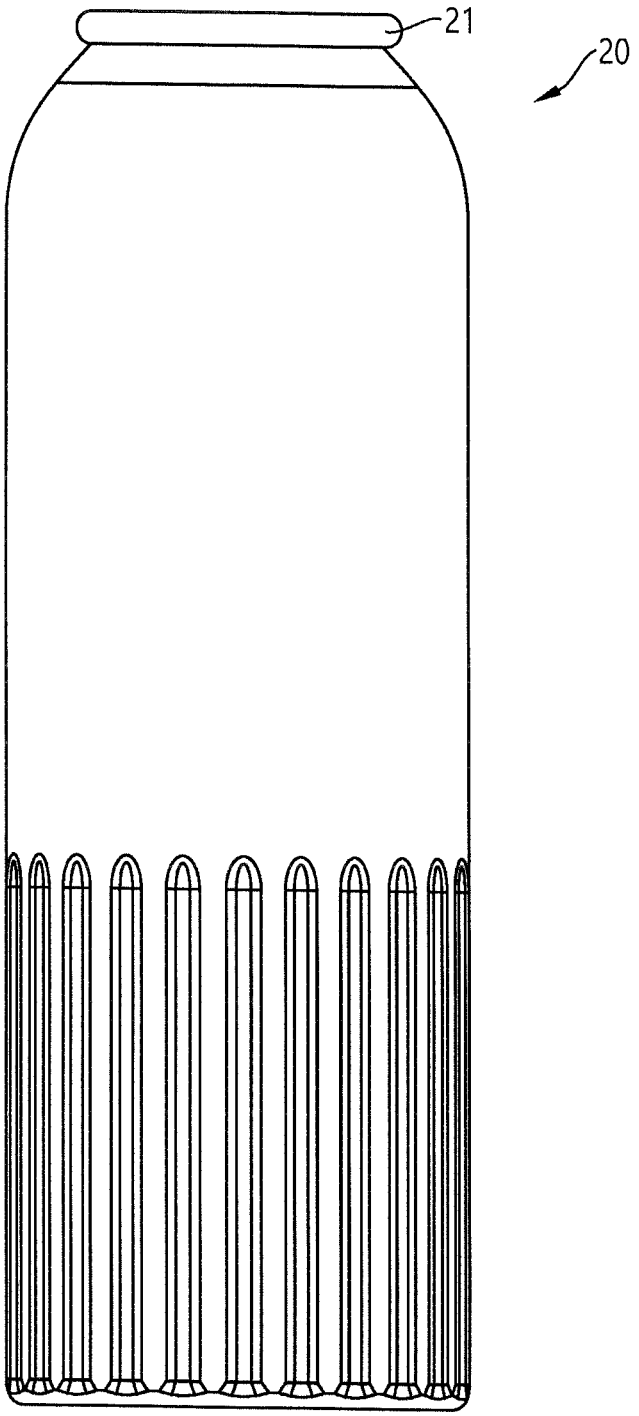
FIG. 5 shows in a diagrammatic representation a can packaging according to the invention produced from the can packaging blank according to a FIG. 4A in a side plan view.

FIG. 5 shows in a diagrammatic representation in a side plan view a can packaging 20 according to the invention which is produced from can packaging blank 10 according to FIG. 4A. Proceeding from can packaging blank 10 according to FIG. 4A, only the post-processing of the opening of can packaging blank 10 facing away from the can packaging bottom and known to the person skilled in the art was carried out to produce finished can packaging 20. This includes for example the formation of the can shoulder and the flanging of the can packaging wall at its opening for the formation of rolled edge 21.

While the invention has been shown and described, it will be understood that there is no intent to limit the invention by such disclosure, but rather, is intended to cover all modifications and alternate constructions falling within the spirit and scope of the invention.

LIST OF REFERENCE NUMBERS

1 Device
2 Die
2.1 Die bottom
2.2 Die wall
3 Punch
4 Projection
5 Bead
6 Circular blank

10 Can packaging blank
11 Groove-like depressions
12 Wall
12.1 Outer surface of the wall
12.2 Inner surface of the wall
20 Can packaging
21 Bead
B Width of the projection
H Height of the projection
T Depth of the projection
HG Height of the die wall
HR Thickness of the circular blank
HA Main axis of the can packaging blank
LR Longitudinal direction
TB Partial region of the can packaging blank
WD Wall thickness of the can packaging blank

The invention claimed is:

1. A device for the production of a can packaging blank by reverse extrusion, wherein the device comprises a die and a punch, wherein the die comprises a die bottom and a die wall with a die wall height, the die wall comprises in a region adjacent to the die bottom at least one projection with a predetermined width, a predetermined height, predetermined depth and predetermined cross-section, wherein the height of the projection amounts to a maximum of 95% of the die wall height, wherein the at least one projection has a cross-section parallel to the die bottom, and wherein the cross-section has a circular segment shaped form.

2. The device according to claim 1, wherein the at least one projection of the die wall comprises a plurality of projections in the region adjacent to the die bottom.

3. The device according to claim 2, wherein the plurality of projections have a different width and/or different height and/or different depth and/or different cross-section, wherein the height of each of the plurality of projections amounts in each case to a maximum of 95% of the die wall height.

4. The device according to claim 1, wherein the at least one projection has a width of 0.1 mm to 10 mm.

5. The device according to claim 1, wherein the at least one projection has a height of 0.1 mm to 30 mm.

6. The device according to claim 1, wherein at least one the projection has a depth of 0.01 mm to 1 mm.

7. The device according to claim 1, wherein the at least one projection is arranged circumferentially around an entire circumference of the die wall.

8. The device according to claim 1, wherein the die bottom is formed circular, oval, rectangular, square, triangular or polygonal, and wherein the die wall is arranged vertically on the die bottom.

9. A method for the production of a can packaging blank by reverse extrusion, comprising the steps a) provision of a device according to claim 1,
b) insertion of a circular blank having a thickness into the die,
c) introduction of the punch and exertion of a pressing force on a circular blank, and
d) removal of the can packaging blank from the die.

10. The method for the production of a can packaging blank according to claim 9, wherein the at least one projection provided in a region of the die wall adjacent to the die bottom has a predetermined height, wherein the predetermined height amounts to a maximum of 95% of the thickness of the circular.

11. The method for the production of a can packaging blank according to claim 9, wherein the at least one projection provided in the region of the die wall adjacent to the die bottom has a predetermined height, wherein the height amounts to at least 5% of the thickness of the circular blank.

12. A can packaging blank produced according to the method according claim 9.

13. A device for the production of a can packaging blank by reverse extrusion, wherein the device comprises a die and a punch, wherein the die comprises a die bottom and a die wall with a die wall height, the die wall comprises in a region adjacent to the die bottom at least one projection with a predetermined width, a predetermined height, predetermined depth and predetermined cross-section, wherein the height of the projection amounts to a maximum of 95% of the die wall height, wherein the at least one projection has a cross-section parallel to the die bottom, and wherein the cross-section has a semicircular form.

* * * * *